United States Patent [19]

Bruggeman et al.

[11] Patent Number: 4,882,978

[45] Date of Patent: Nov. 28, 1989

[54] BELLOWS PNEUMATIC SYSTEM

[75] Inventors: Jon Bruggeman, North Oaks; Dallas W. Simonette, Stacy, both of Minn.

[73] Assignee: Power Flo Products Corp., Minneapolis, Minn.

[21] Appl. No.: 325,992

[22] Filed: Mar. 20, 1989

Related U.S. Application Data

[62] Division of Ser. No. 180,217, Apr. 11, 1988, Pat. No. 4,824,340.

[51] Int. Cl.[4] ..... F01B 19/00; F16J 3/04; B29C 43/00

[52] U.S. Cl. ..... 92/34; 92/47; 264/506; 264/526; 425/536

[58] Field of Search ..... 92/34, 40, 43, 47, 103 R, 92/103 SD; 264/506, 526; 425/535, 536

[56] References Cited

U.S. PATENT DOCUMENTS

| | | | |
|---|---|---|---|
| 3,606,623 | 9/1971 | Aymar | 417/472 |
| 4,644,980 | 8/1984 | Yoshida | 92/34 |

FOREIGN PATENT DOCUMENTS

| | | | |
|---|---|---|---|
| 2137492 | 2/1972 | Fed. Rep. of Germany | 92/34 |
| 31468 | 3/1979 | Japan | 264/506 |
| 2033750 | 5/1980 | United Kingdom | 92/34 |

OTHER PUBLICATIONS

Steere Enterprises, Inc., Blow Molded Bellows, 1982.

*Primary Examiner*—Robert E. Garrett
*Assistant Examiner*—Mark A. Williamson
*Attorney, Agent, or Firm*—Peterson, Wicks, Nemer & Kamrath

[57] ABSTRACT

A pneumatic system (10) is shown in its most preferred use in a spray gun (12) to remotely control a pressure washer. The system (10) generally includes an integrally formed, homogenous squeeze box (40) including a location ear (52), a nose tube (46), a bellows (44), and a discharge tube (48). Bellows (44) is generally rectangular in cross section and includes a flat top (62) and bottom (63) and accordion sides (64) having generally longitudinal fold lines (72, 74, 76, 78, 80) which are generally parallel to the mold part line (93) and the tubes (46, 48) but include a 2° draft for ease in mold removal. A valve and spring tube (42) is loosely received on the nose tube (46) for sealing a vent hole (60) provided therein when the bellows (44) is compressed by a trigger (30) of gun (12) and for biasing the trigger (30) to an uncompressed bellows condition. In its most preferred form, the squeeze box (40) is blow molded, with the bellows cavities (44') of the mold halves (92, 94) having a generally trapezoidal cross section defining major longitudinal undercuts (102).

10 Claims, 2 Drawing Sheets

BELLOWS PNEUMATIC SYSTEM

This is a divisional of co-pending application Ser. No. 07/180,217 filed on Apr. 11, 1988, now U.S. Pat. No. 4,824,340.

BACKGROUND

The present invention relates generally to bellows, specifically to vented bellows, and particularly to pneumatic system bellows and their method of manufacture.

It is often desirable to remotely control an electrical system utilizing air pressure to reduce the possibility of sparks and/or electrocution. As an example, such control systems may be utilized in high pressure washers where water is pressurized for spraying upon surfaces desired to be cleaned. So as to prevent unintentional pressurization of the pneumatic system due to changes in temperature or atmospheric pressure, such systems are normally vented to the atmosphere. Thus, a need has arisen for vented bellows which are particularly advantageous for use in control systems which are of a simple design including few parts which are simple and economical to manufacture and assemble and which include provisions for selectively sealing the vent to the atmosphere. Similarly, a need has arisen for pneumatic systems for other applications which are of a simple design including few parts which are simple and economical to manufacture and assemble.

The present invention solves this and other needs in the design of pneumatic systems by providing, in the preferred form, a valve tube loosely received on a vent hole tube having a vent hole located intermediate the ends of the valve tube. The member which compresses the bellows of the pneumatic system also compresses the valve tube to seal the vent hole.

In another aspect of the present invention, an integral pneumatic system formed of homogeneous material is provided including bellows located intermediate first and second tubes. The bellows have a generally rectangular cross section and include a flat top and bottom add accordion sides having longitudinal fold lines which are generally parallel to the first and second tubes.

Additionally, in still another aspect of the present invention, th pneumatic system is blow molded in first and second mold halves having a bellows cavity located intermediate first and second tube cavities. The free end of the first tube is sealed and the blow is introduced into the free end of the second tube. The bellows cavity is generally trapezoidal in cross section defining major longitudinal undercuts.

Thus, it is an object of the present invention to provide a novel pneumatic system.

It is further an object of the present invention to provide such a novel pneumatic system of a simple design.

It is further an object of the present invention to provide such a novel pneumatic system including few parts.

It is further an object of the present invention to provide such a novel pneumatic system which is simple and economical to manufacture and assemble.

It is further an object of the present invention to provide such a novel pneumatic system having a two-stage actuation for closing a vent hole and then compressing a bellows.

It is further an object of the present invention to provide such a novel pneumatic system including a novel vent hole sealing structure.

It is further an object of the present invention to provide such a novel pneumatic system where the vent hole sealing structure biases the member which compresses the bellows.

It is further an object of the present invention to provide such a novel pneumatic system which is integrally formed of homogeneous material.

It is further an object of the present invention to provide such a novel pneumatic system having bellows including longitudinal fold lines.

It is further an object of the present invention to provide such a novel pneumatic system having bellows including longitudinal fold lines generally parallel to the mold part line.

It is further an object of the present invention to provide such a novel pneumatic system which may be blow molded.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2, 3, 4, 5, 6, 7:
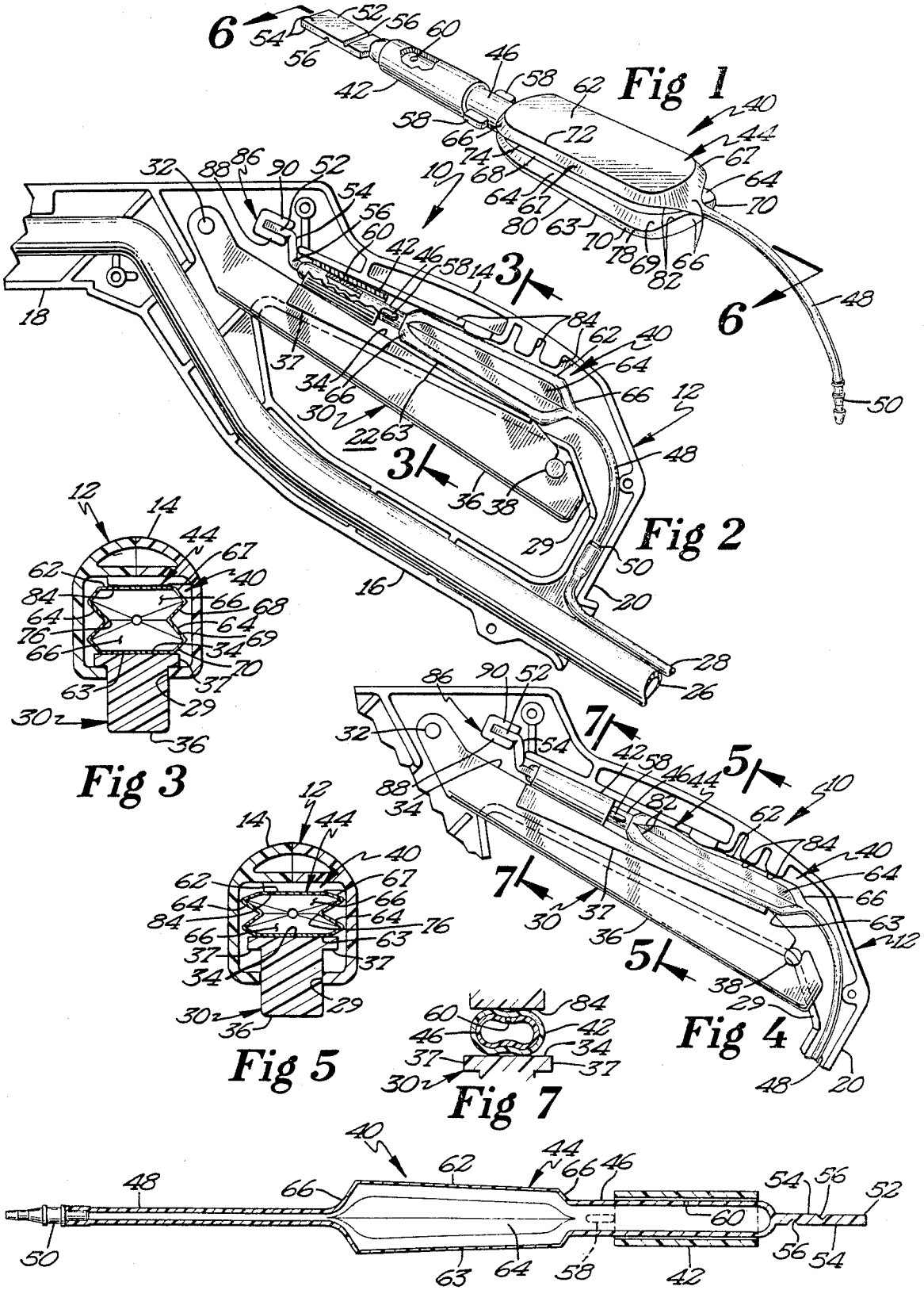
FIG. 1 shows a perspective view of a squeeze box including a valve and spring tube located thereon according to the preferred teachings of the present invention, with portions of the tube broken away.
FIG. 2 shows a sectional view of the squeeze box including a valve and spring tube located thereon of FIG. 1 in a spray gun of a high pressure washer in a normal, nonactuated position according to the preferred teachings of the present invention.
FIG. 3 shows a sectional view of the spray gun of FIG. 2 according to section line 3—3 of FIG. 2.
FIG. 4 shows a partial sectional view of the squeeze box including a valve and spring tube located thereon of FIG. 1 in a spray gun of a high pressure washer in an actuated position according to the preferred teachings of the present invention.
FIG. 5 shows a sectional view of the spray gun of FIG. 4 according to section line 5—5 of FIG. 4.
FIG. 6 shows a sectional view of the squeeze box including a valve and spring tube located thereon of FIG. 1 according to section line 6—6 of FIG. 1.
FIG. 7 shows a sectional view of the spray gun of FIG. 4 according to section line 7—7 of FIG. 4.
Figure 8:
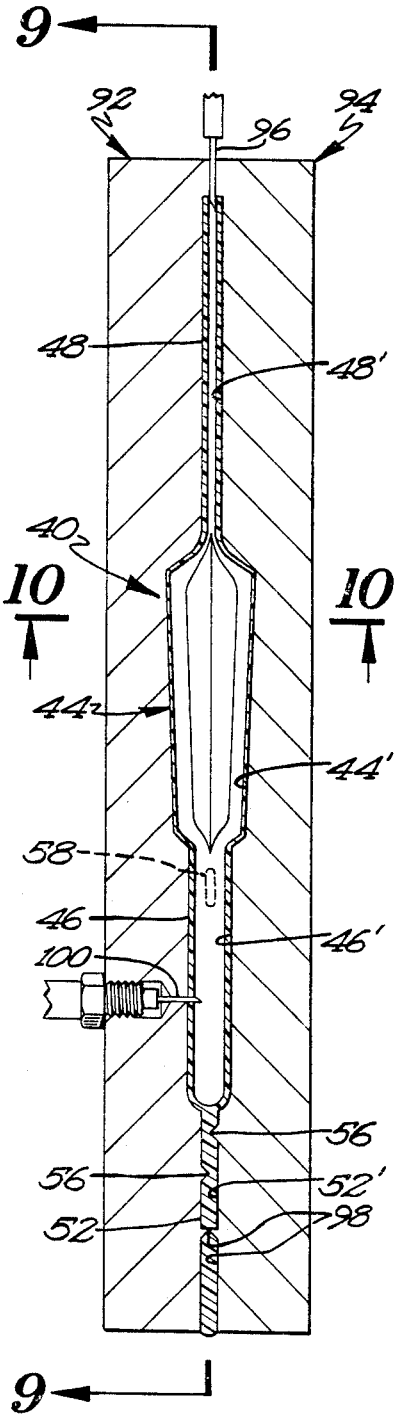
FIG. 8 shows a sectional view of the mold for forming the squeeze box of FIG. 1.
Figure 9:
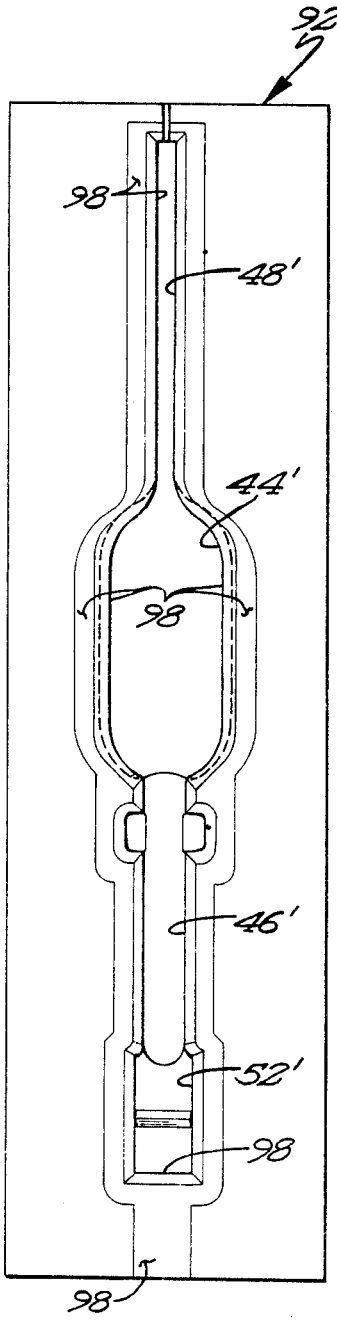
FIG. 9 shows an elevational view of one of the mold halves of FIG. 8 according to view line 9—9 of FIG. 8.
Figure 10:
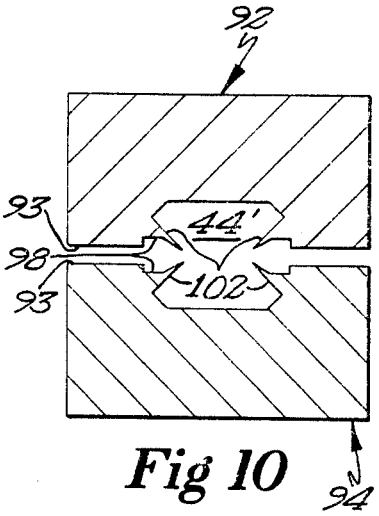
FIG. 10 shows a sectional view of the mold of FIG. 1 according to section line 10—10 of FIG. 8.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "end", "side", "edge", "face", "first", "second", "longitudinal", "inside", "outside", "outer", "inner", "interior", and similar terms are used herein, it should be understood that these terms have reference only to the structure shown in the drawings as it would appear to a person viewing the drawings and are utilized only to facilitate describing the invention.

DESCRIPTION

A bellows pneumatic system according to the preferred teachings of the present invention is shown in the drawings and is generally designated 10. In its most preferred form, system 10 is shown for use in a spray gun 12 of a high pressure washer. Gun 12 generally includes a body formed in the most preferred form by two longitudinal halves which are secured together to define a hollow interior. The body generally includes a handle or grip portion 14, a trigger guard 16, a wand 18, and an interconnection portion 20. The first ends of grip portion 14 and guard 16 are interconnected together to form a hand opening 22 therebetween. The second ends of grip portion 14 and guard 16 are interconnected to the opposite ends of interconnection portion 20. The wand 18 is connected to and extends in the opposite direction from the first ends of grip portion 14 and guard 16 at an obtuse angle in the range of 140°. In the most preferred form, a water line 26 extends through the interior of guard 16 and wand 18. Water line 26 transfers high pressure water from the pump of the high pressure washer to the spray outlet or nozzle of gun 12. An air logic line 28 extends into the second end of guard 16 and into the interconnection portion 22. Air line 28 is in fluid communication with a pressure actuated electrical switch which controls the motor for the pump of the high pressure washer.

In the most preferred form, grip portion 14 includes a longitudinal trigger aperture 29 extending therethrough and aligned with hand opening 22 and guard 16. The first end of a trigger 30 is pivotally mounted about an axis 32 located adjacent the first end of the grip portion 14 for pivotal movement in aperture 29 into and out of the interior of grip portion 14. Trigger 30 includes a first side 34 located within the interior of grip portion 14 and a second side 36 generally parallel to side 34 and located within hand opening 22 and engageable by the hand of the operator when wrapped around the grip portion 14 and through opening 22. Trigger 30 may include flanges 37 extending generally contiguous with and on opposite sides of side 34 for abutting with grip portion 14 around aperture 29 for retaining trigger 30 in gun 12. Trigger 30 may further include a safety interlock 38 adjacent its second end having a first position which abuts with grip portion 14 to prevent pivotal movement of side 34 into the interior of grip portion 14 and a second, non-interfering position with grip portion 14 allowing pivotal movement of side 34 into the interior of grip portion 14.

System 10 in the most preferred form includes a squeeze box 40 and a valve and spring tube 42 received thereon. Squeeze box 40 generally includes a bellows 44 located intermediate a first, barrel or nose tube 46 and a second, discharge tube 48. The free end of tube 48 includes suitable provisions 50 such as a barbed connector for providing fluid interconnection with air line 28. Tube 48 in the most preferred form is cylindrical in shape and has an inner diameter of 0.06 inches (0.15 cm) and has a wall thickness of 0.03 inches (0.075 cm).

The free end of nose tube 46 is closed and terminates in and is sealed by a generally solid location tab or-ear 52 having a generally rectangular cross section, including upper and bottom faces 54. which lie along the mold part line and are generally parallel to the longitudinal axis. Bend notches 56 such as V grooves may be formed in faces 54. In the preferred form, ear 52 has a relatively large wall thickness to provide increased firmness over the other portions of squeeze box 40 and has a height in the range of 0.12 inches (0.30 cm). In the preferred form, ear 52 may be hollow and in the most preferred form may include two sealed volumes as the result of the closed free end of ear 52 and notches 56. The width of ear 52 is slightly larger than the outer diameter of nose tube 46 and in the most preferred form has a width of 0.38 inches (0.97 cm).

Nose tube 46 in the most preferred form is cylindrical in shape and has an inner diameter of 0.22 inches (0.56 cm) and has a wall thickness of 0.03 inches (0.075 cm). Additionally, stops 58 are provided on opposite sides of nose tube 46 adjacent bellows 44 which lie along the mold part line and are parallel to the longitudinal axis and ear 52. A vent hole 60 is provided generally centrally in nose tube 46 for fluid communication with bellows 44 and extends generally perpendicular to the mold part line, to the longitudinal axis, and to ear 52 and stops 58. The wall thickness of nose tube 46 such as in a manner as disclosed for the preferred embodiment is important for providing vent hole 60 with a durable but yet flexible seat area for valve and spring tube 42.

Bellows 44 are generally rectangular in cross section and include a generally rectangular, flat top 62, a generally rectangular, flat bottom 63, longitudinal folding, accordion sides 64, and transitional ends 66. In the most preferred form, top 62 and bottom 64 have generally semicircular ends connected by generally straight sides. Generally, side 64 includes four generally rectangular panels 67, 68, 69, and 70 including relatively sharp, longitudinal fold line interconnections. Specifically, panel 67 is integrally formed with the side of top 62 by fold line 72 about an angle in the range of 45°. Panel 68 is integrally formed with panel 67 by fold line 74 about an angle in the range of 90°. Panel 69 is integrally formed with panel 68 by central fold line 76 about an angle in the range of 90°. Panel 70 is integrally formed with panel 69 by fold line 78 about an angle in the range of 90°. Panel 70 is integrally formed with the side of bottom 63 by fold line 80 about an angle in the range of 45°. In the preferred form, fold lines 76 lie along the mold part line and are generally parallel to the longitudinal axis. Fold lines 72 and 74 and top 62 are parallel to each other and fold lines 78 and 80 and bottom 63 are parallel to each other, with fold lines 72, 74, 78, and 80, top 62, and bottom 63 being substantially parallel to the mold part line and the longitudinal axis and in the preferred form having a slight angle in the range of 2° with bellows 44 having a slightly larger spacing adjacent feed tube 48 than nose tube 46.

The wall thickness of bellows 44 according to the preferred construction of the present invention is $\frac{1}{2}$ to $\frac{1}{3}$ the wall thickness of tubes 46 and 48. In the most preferred form, the spacing between fold lines 76 of sides 64 is generally equal to but slightly larger than the outside diameter of nose tube 46. The width of panels 67 and 70 are generally equal and in the range of one-half the width of panels 68 and 69, with the width of panels 68 and 69 being equal.

Transitional ends 66 extend generally accurately from tubes 46 and 48 continuously into panels 67 and 70 and intersect at fold lines 82 with panels 68 and 69. Transitional ends 66 according to the teachings of the present invention allow bellows 44 to maintain its overall strength and reduce pin point fatigue. Transitional ends 66 also provide a smooth mold removal surface to allow bellows 44 and squeeze box 40 to be removed from the mold with minimal or no damage to bellows 44.

It can then be appreciated that squeeze box 40 is integrally formed as one piece of homogeneous material which in the preferred form is blow molded and which includes a mounting or ear portion 52, a venting or nose portion 46, a bellows portion 44, and a discharge tube or portion 48. It may be appreciated that this one piece formation is especially advantageous in regard to its manufacture and to its assembly in gun 12 according to the teachings of the present invention. In its most preferred form, squeeze box 40 is formed of low density polyethylene.

In the preferred form, valve and spring tube 42 is generally cylindrical and has an inside diameter slightly larger than the outside diameter of nose tube 46 and less than the width of ear 52 and stops 58 and in the most preferred form has an inside diameter in the range of 0.32 inches (0.81 cm). Valve and spring tube 42 is formed of a resilient material having memory and different than squeeze box 40 such that squeeze box 40 and tube 42 do not stick or cling together and in the most preferred form is formed of 70 durameter PVC. Valve and spring tube 42 is simply positioned on nose tube 46 by forcing valve and spring tube 42 over ear 52 and is not glued or otherwise secured thereon but is retained on nose tube 46 by the abutment of its ends with and between ear 52 and stops 58. Thus. vent hole 60 is located intermediate the ends of valve and spring tube 42. The size and shape of stops 58 must exceed that of the inside diameter of valve and spring tube 42 even under full deformation by trigger 30.

Grip portion 14 of gun 12 includes an abutment 84, shown in the drawings as a molded ledge and ribs, extends generally parallel to aperture 29 and first side 34 and in the most preferred form is at a slight angle such that the spacing increases from the first end to the second end of grip portion 14. A U-shaped rib 86 is integrally formed in the interior of grip portion 14 in front of and spaced from abutment 84. In the most preferred form, rib 86 includes a first leg 88 which is generally in line with abutment 84 and a second leg 90 is generally parallel with and spaced above leg 88 a distance generally equal to the thickness of ear 52, with leg 90 being in the opposite direction from leg 88 than aperture 29 and trigger 30.

Squeeze box 40 including valve and spring tube 42 is positioned in gun 12 with nose portion 46 and tube 42 and with bellows 44 located between side 34 of trigger 30 and abutment 84. In the most preferred form, ear 52 is held by an interference friction or locking fit in U-shaped rib 86 and between rib 86 and abutment 84 to anchor the free end of squeeze box 40 in grip portion 14 of gun 12. Specifically, using the memory of the material forming ear 52 for reinforcement, ear 52 is received in U-shaped rib 86 and bent in a generally Z-shaped configuration to extend around the end of and below abutment 84. Notches 56 allow positioning ear 52 in this configuration and specifically allows ear 52 to be bent through the angles around leg 88 and abutment 84. Ear 52 must have sufficient material thickness to prevent it from being pulled from and between rib 86 and abutment 84. It can than be appreciated that squeeze box 40 is secured in the interior of grip portion 14 without the necessity of gluing, tightening or clamping any moveable parts such that assembly can be rapidly and easily performed by simply positioning squeeze box 40 within rib 86 and between abutment 84 and trigger 30. Further, the number of parts and the cost of manufacture of gun 12 is similarly reduced according to the teachings of the present invention.

It can then be appreciated that the angle of top 62 and bottom 63 of bellows 44 and the increased height of bellows 44 than nose tube 46 and valve and spring tube 42 generally follows the angled spacing between trigger 30 and abutment 84 such that squeeze box 40 including tube 42 is generally captured between trigger 30 and abutment 84. Further, this arrangement also takes advantage of the relative pivotal distances traveled along the length of trigger 30 as it pivots about axis 32, with a point closer to axis 32 traveling a distance less than a point located farther away from axis 32.

Now that the basic construction of system 10 according to the preferred teachings of the present invention has been explained, the operation and subtle features of system 10 can be set forth and appreciated. In a normal condition, tube 42 biases trigger 30 out of grip portion 14 of gun 42 due to the resiliency and memory of the material from which it is made. Further, due to the differences of material between tube 42 and nose tube 46 and also due to the resiliency and memory of tube 42, air is able to enter between tube 42 and nose tube 46 and pass through vent hole 60 to the interior of squeeze box 40. Thus, squeeze box 40 is normally vented to the atmosphere to prevent an unintentional increase in pressure in the interior of squeeze box 40 as the result of changes in temperature or atmospheric pressure.

When it is desired to actuate system 10, gun 12 may be gripped by the operator's hand and trigger 30 may be squeezed. As trigger 30 is squeezed, initially tube 42 is compressed to engage nose tube 46. Due to the positioning of vent hole 60 generally perpendicular to the mold part line and also to abutment 84, compression of tube 42 collapses tube 42 to engage with nosetube 46 and seal vent hole 60 to prevent air from escaping the interior of squeeze box 40. Upon further squeezing of trigger 30, trigger 30 pushes squeeze box 40 against abutment 84 to collapse bellows 44 forcing the air in the interior of squeeze box 40 to be discharged from discharge tube 48 into air line 28 resulting in a small but significant pressure increase which is enough to activate the pressure actuated electrical switch. It can then be appreciated that the squeezing of trigger 30 also may at least partially collapse nose tube 46 which would also effectively increase the volume of squeeze box 40 for purposes of pressurization.

Upon release of the grip on trigger 30 by the operator, tube 42 acts as a spring in biasing trigger 30 to pivot out of grip portion 14 and into hand opening 22 of gun 12. With the expansion of the spacing between abutment 84 and trigger 30, the sealing of vent hole 60 is released such that air is allowed to enter the interior of squeeze box 40 to thus reduce the pressure in the interior of squeeze box 40 and air line 28 to that of atmospheric pressure. Thus, trigger 30 may return to its normal condition for selective actuation in the similar manner.

It can then be appreciated that tube 42 serves several purposes as an active part of the squeeze box 40 and obtains several advantages. First, tube 42 acts as a dirt barrier to vent hole 60 when vent hole 60 is open to atmospheric pressure. Dirt or other foreign matter carried by the air is less likely to travel into and between tubes 42 and 46 and to block vent hole 60 than if vent hole 60 were not covered. Additionally, tube 42 acts as a valve in opening and closing vent hole 60 in a manner as described. It should also be appreciated that tubes tend to have surface roll-under or tend to dish in the center when compressed. This was disadvantageous where the vent hole was not covered and directly contacted the abutment surface as the vent hole often was located in this dished center which then allowed air to escape. The present invention on the other hand takes advantage of this effect since this dished area of tube 42 tends to contact tube 46 which is of a less compressible material to insure sealing of vent hole 60. It can then be further appreciated that due to the inside diameter of tube 42 being slightly larger than the outside diameter of nose tube 46, the sealing area of tube 42 with vent hole 60 is maximized such that placement and alignment of vent hole 60 relative to the remaining components of system 10 and the location of tube 42 on nose tube 46 are not as critical. Further, tube 42 acts as a spring in biasing trigger 30 such that mechanical springs or other biasing members are not required to reduce the number of components and the cost of manufacture and assembly. It can then be appreciated that since tube 42 has better memory than nose tube 46 and due to the differences in material to prevent sticking or clinging, tube 42 tends to separate quickly from tube 42 to automatically open or vent vent hole 60 to the atmosphere when trigger 30 is released by the operator. Similarly, use of tube 42 as a spring for biasing trigger 30 rather than relying on squeeze box 40, cuts down on the material fatigue placed on squeeze box 40 to increase its life. Likewise, tube 42 according to the teachings of the present invention allows the elimination of play in trigger 30 and provides better and more consistant firmness of trigger 30 in relation to the distance of trigger travel. The thickness of the walls, the selection of materials including their hardness, and the roundness and the quality of the finish on nose tube 46 such as in a manner as disclosed for the preferred embodiment is important to enhance the life and operation of squeeze box 40 and tube 42.

Bellows 44 are also of a preferred construction according to the teachings of the present invention which are believed to be advantageous. Bellows 44 act as a compression chamber for the purpose of creating a pressure greater than that of atmospheric upon actuation of trigger 30. Specifically, the rectangular cross section of bellows 44 increases the volume of bellows 44 over the same size cylindrical bellows. The volume of bellows 44 determines the degree of pressurization and the amount of trigger movement required to actuate the pressure actuated electrical switch. Similarly, accordion sides 64 allow bellows 44 to flex under compression while maintaining a consistant size in width. This feature of bellows 44 according to the teachings of the present invention aids in preventing bellows 44 from interference or frictional engagement when enclosed in the longitudinal halves forming the body of gun 12. Likewise, side 34 and abutment 84 abutting against flat top 62 and bottom 63 increases the area efficiency in collapsing bellows 44. Further, flat top 62 and bottom 63 reduces movement of bellows 44 on side 34 and abutment 84 such that bellows 44 is self centering as opposed to cylindrical bellows which may have a tendency to roll and provide no center control in relation to the abutment surfaces. Further, the 2° draft of fold lines 72, 74, 78, and 80, top 62, and bottom 63 allow bellows 44 to be as uniform as possible under compression due to the relative travel distances along the length of trigger 30 as it is pivoted about axis 32 to give bellows 44 its greatest efficiency. The construction of accordion sides 64 in a manner as disclosed for the present invention provides consistent flexing such that similar movement of trigger 30 by the operator provides switch actuation.

It can further be appreciated that the relationships of system 10 such as set forth for the preferred construction according to the teachings of the present invention are believed to be advantageous. Specifically, compression of valve and spring tube 42 occurs initially prior to any significant compression of bellows 44. Thus, tube 42 seals vent hole 60 to prevent the escape therefrom prior to the creation of an air pressure increase by the compression of bellows 44. This dwell between the sealing of vent hole 60 and the compression of bellows 44 transforms the continued movement of trigger 30 into a two-stage or step actuation of squeeze box 40 and tube 42. Additionally, nose tube 46 being firmer than tube 42 according to the teachings of the present invention insures that tube 42 compresses into and catches up with nose tube 46 to seal vent hole 60 prior to the compression of nose tube 46. Similarly, the relationship of trigger 30, squeeze box 40, tube 42 and abutment 84 according to the teachings of the present invention facilitates that biasing occurs by tube 42 and not significantly by bellows 44 to reduce material fatigue in bellows 44 which includes the smallest wall thickness and the convolutions subject to the greatest possibility of failure.

It can then be appreciated that uue to the preferred construction of squeeze box 40 according to the teachings of the present invention, sufficient air pressure should be developed such that it is not necessary to completely compress bellows 44 and nose tube 46 such that the inner surfaces touch each other. Such touching may cause adhering, sticking, or clinging of the inside surfaces together especially in certain materials such as PVC which is a common material for blow molding, with such adhering, sticking and clinging possibly affecting expansion when actuation pressure by the operator is removed.

In the most preferred form, squeeze box 40 is formed from blow molding. Particularly, parisn is metered between the spaced vertical part lines 93 of mold halves 92 and 94 through a valve which controls the rate and amount of parison for the desired wall thicknesses and length of the various portions of squeeze box 40. In the preferred form, mold halves 92 and 94 are vertically orientated with the cavities 52' for forming ear 52 being located at the bottom to allow a 100% sealed end and the cavities 48' for forming discharge tube 48 located at the top to allow the introduction of the blow of air therethrough. Cavities 46' and 48' in mold halves 92 and 94 lie along part line 93 and are generally semicircular in cross section. Pinch off surface and areas 98 extend around the cavities 44', 46', 48' and 52' except the top where the parison enters mold halves 92 and 94.

It can then be appreciated that in this arrangement, the heaviest wall and material amount is located at the bottom of the metered parison, which is contrary to common blow molding practice. Additionally, the transitions in wall thickness along the length of squeeze box 40 are very drastic, with the smallest wall thickness for bellows 44 being located generally intermediate the location of air introduction by blow pin 96 and ear 52 which has the largest wall thickness. Thus weight is a significant concern as gravity tends to accelerate the parison for bellows 44 and discharge tube 46 toward the bottom which makes metering for wall thicknesses difficult. So timing is an important factor in the creation of squeeze box 40 and it is necessary to blow and close mold halves 92 and 94 prior to the parison traveling to undesired positions or falling off.

At the correct time and generally simultaneously, mold halves 92 and 94 close and air is introduced by blow pin 96 in the normal manner, aside from the air being introduced in the free end of the parison forming discharge tube 48 according to the teachings of the present invention. When mold halves 92 and 94 close, the extra material is sheared off by pinched off surfaces and areas 98 formed in mold halves 92 and 94.

According to the teachings of the present invention, slightly after the introduction of air into the parison by blow pin 96, a second blow pin 100 in mold half 92 is introduced into cavity 46' forming nose tube 46 generally perpendicular to mold part line 93. Thus, blow pin 100 is not utilized for blowing or air introduction which is their standard use, but is utilized as a mechanical punch to form vent hole 60. It can then be appreciated that timing is an important factor and it is necessary to delay introduction of blow pin 100 until after formation of nose tube 46 but not for too long a period so that cooling of the parison prevents entry of blow entry. In the most preferred form, the introduction of blow pin 100 is pneumatically actuated by an air cylinder and in the preferred form, actuation is controlled by a pneumatic delay timer in series with the air for introduction into the parison.

Further according to the teachings of the present invention, cavities 44' of mold halves 92 and 94 for forming bellows 44 are generally isosceles trapezoidal in cross section defining major undercuts 102. Specifically, the minor side of cavities 44' is formed on part line 93 and form fold lines 76 while the major side of cavities 44' forms top 62 in mold half 92 and bottom 63 in mold half 94. The ends of cavities 44' form panels 67 and 68 and fold lines 72 and 74 in mold half 92 and form panels 69 and 70 and fold lines 78 and 80 in mold half 94. Major undercuts 102 forming bellows 44 include fold lines 72, 74, 76, 78, and 80 which are generally parallel to mold part line 93 and the parison travel direction in mold halves 92 and 94. Thus, the bellow actuation direction is generally perpendicular to mold parting line 93 and to the blow direction of blow pin 96. This is unique to the present invention and requires bellow design consideration to allow removal. Specifically, after mold halves 92 and 94 are cooled and opened in the usual manner for blow molding, squeeze box 40 is manually pulled from mold halves 92 and 94 by pulling on discharge tube 48. It can then be realized that undercuts 102 in mold halves 92 and 94 hold squeeze box 40 in mold halves 92 and 94. Bellows 44 according to the teachings of the present invention include features which lend themselves towards ease of removal with minimal or no damage. Specifically, the decreasing in size trapezoidal cross section of cavity 44' creating the 2° draft of fold lines 72, 74, 78, and 80, top 62, and bottom 63 toward the back of bellows 44 assists in the ease of removal of bellows 44 from undercuts 102 of mold halves 92 and 94. Additionally, transitional ends 66 according to the teachings of the present invention present smooth surfaces which allow ease of longitudinal removal of bellows 44 from mold halves 92 and 94 generally parallel to mold part line 93.

Now that the basic teachings of the present invention have been explained, many extensions and variations will be obvious to one having ordinary skill in the art. For example, although trigger 30 and abutment 84 have been shown for selectively compressing tube 42 and bellows 44 according to the preferred teachings of the present invention, other forms of actuation may be utilized according to the teachings of the present invention.

Similarly, although system 10 has been set forth for use in a spray gun 12 of a high pressure washer in the preferred form, system 10 may be utilized in other control applications or in other fluid movement systems according to the teachings of the present invention.

Likewise, although several unique features have been synergistically utilized in system 10 in the preferred form which is believed to be particularly advantageous, such features may be separately utilized or utilized in differing combinations according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Pneumatic system comprising, in combination: a bellows having a generally rectangular cross section, with the bellows comprising, in combination: a generally flat top, a generally flat bottom, first and second accordion sides having longitudinal fold lines, and first and second ends; a first tube integrally formed with and extending from the first end of the bellows generally parallel to the longitudinal fold lines of the accordion sides; and a second tube integrally formed with and extending from the second end of the bellows generally parallel to the longitudinal fold lines of the accordion sides and in line with the first tube, with the bellows and first and second tubes being formed of homogeneous material.

2. The pneumatic system of claim 1 wherein the bellows and first and second tubes are molded between first and second mold halves having a parting line; wherein the accordion sides include at least a first, central fold line and second and third fold lines on opposite sides of the central fold line, with the first and second tubes and the central fold lines of the first and second accordion sides lying along the parting line of the mold halves.

3. The pneumatic system of claim 2 wherein the bellows and first and second tubes are blow molded by blowing in the free end of the second tube; wherein the top and bottom of the bellows extend at a slight angle in the range of 2° to the central fold line with the bellows having a decreasing height from the second tube towards the first tube for assisting in the removal from the mold halves by pulling on the free end of the second tube generally parallel to the mold part line.

4. The pneumatic system of claim 2 further comprising, in combination: a location ear, with the first tube terminating in the location ear, with the location ear lying along the parting line of the mold halves, with the location ear sealing the free end of the first tube.

5. Method for blow molding a pneumatic system including first and second tubes and a bellows comprising the steps of:

(a) providing first and second spaced mold halves having a vertical part line, with the mold halves each having a first tube cavity, a bellows cavity, and a second tube cavity, with the first and second tube cavities having first ends which terminate in the bellows cavity and second ends, with the first and second tube cavities having generally semicircular cross sections, with the free end of the first tube cavity being closed, with the free end of the second tube cavity being open for the introduction of the blow, with the bellows cavity having a generally trapezoidal cross section defining major longitudinal undercuts;

(b) introducing parison between the first and second mold halves;

(c) closing the spacing of the first and second molds and generally simultaneously introducing the blow at the second end of the second tube cavity;

(d) cooling the mold halves;

(e) separating the first and second mold halves; and (f) pulling the second end of the second tube in a direction parallel to the part line for removing the pneumatic system from the mold halves.

6. The method of claim 5 further comprising the step of:

(g) introducing a second blow pin into the first tube cavity of the first mold half generally perpendicular to the mold part line for mechanically punching a vent hole in the first tube slightly after the introduction of the blow at the free end of the second tube.

7. The method of claim 5 wherein the generally trapezoidal cross section of the bellows cavity decreases in size from the second tube cavity to the first tube cavity to create a draft angle for assisting removal of the molded bellows from the bellows cavity.

8. The method of claim 7 wherein the generally trapezoidal cross section of the bellows cavity terminates in generally arcuate transitions to the tube cavities for assisting removal of the molded bellows from the bellows cavity.

9. The method of claim 5 wherein the free end of the first tube cavity terminates in a location ear cavity having a generally rectangular cross section.

10. The method of claim 9 wherein the step of introducing parison comprises the step of metering the parison between the first and second mold halves for varying the wall thickness of the molded pneumatic system.

* * * * *